US008962065B2

(12) United States Patent
Dalal et al.

(10) Patent No.: US 8,962,065 B2
(45) Date of Patent: Feb. 24, 2015

(54) INVISIBLE COMPOSITE SECURITY ELEMENT

(75) Inventors: Edul N. Dalal, Webster, NY (US); Wencheng Wu, Webster, NY (US)

(73) Assignee: Xerox Corporation, Norwalk, CT (US)

( * ) Notice: Subject to any disclaimer, the term of this patent is extended or adjusted under 35 U.S.C. 154(b) by 114 days.

(21) Appl. No.: 13/074,610

(22) Filed: Mar. 29, 2011

(65) Prior Publication Data

US 2012/0251715 A1 Oct. 4, 2012

(51) Int. Cl.

| | |
|---|---|
| ***B41M 3/14*** | (2006.01) |
| ***B44F 1/12*** | (2006.01) |
| ***B42D 25/00*** | (2014.01) |
| ***B42D 25/29*** | (2014.01) |
| *B42D 25/382* | (2014.01) |
| *B42D 25/387* | (2014.01) |

(52) U.S. Cl.

CPC ..... *B42D 25/00* (2014.10); *B42D 25/29* (2014.10); *B42D 2033/20* (2013.01); *B42D 2035/50* (2013.01); *B41M 3/142* (2013.01); *B41M 3/146* (2013.01); *B42D 25/382* (2014.10); *B42D 25/387* (2014.10)

USPC ..... 427/7

(58) Field of Classification Search

USPC ..... 427/8, 7

See application file for complete search history.

(56) References Cited

U.S. PATENT DOCUMENTS

| | | | | |
|---|---|---|---|---|
| 5,605,738 | A * | 2/1997 | McGinness et al. | 428/195.1 |
| 6,588,875 | B1 * | 7/2003 | Kleinhammer | 347/29 |
| 6,673,500 | B1 | 1/2004 | Patel et al. | 430/108.2 |
| 7,495,214 | B2 | 2/2009 | Pan et al. | 250/302 |
| 2002/0090112 | A1 * | 7/2002 | Reed et al. | 382/100 |
| 2004/0151880 | A1 * | 8/2004 | Nakamura et al. | 428/195.1 |
| 2007/0262579 | A1 | 11/2007 | Bala et al. | 283/92 |
| 2008/0191027 | A1 * | 8/2008 | Yang et al. | 235/491 |
| 2010/0075241 | A1 | 3/2010 | Kazmaier et al. | 430/107.1 |
| 2012/0141660 | A1 * | 6/2012 | Fiedler | 427/8 |

FOREIGN PATENT DOCUMENTS

EP 1959403 A2 * 8/2008

* cited by examiner

*Primary Examiner* — Kelly M Gambetta

(74) *Attorney, Agent, or Firm* — Pillsbury Winthrop Shaw Pittman, LLP

(57) ABSTRACT

Disclosed is a composite security element and a method for applying the same to a substrate (e.g., paper). The composite security element has a first pattern mark and a second pattern mark. The first pattern mark is marked in first (active) marking material (e.g., ink) and the second pattern mark is marked in second (passive) marking material. When exposed to light or radiation at wavelengths in the visible spectrum, the first and second pattern marks are indistinguishable from one another (to a naked human eye). When exposed to radiation at least some wavelengths outside of the visible spectrum, the first and second pattern marks are distinguishable from one another (e.g., first pattern reacts to non-visible light). The first pattern mark may be a security mark or symbol, for example. The marking materials may be colorless. Both first and second pattern marks are also associated with similar gloss.

22 Claims, 7 Drawing Sheets

FIG. 3

INVISIBLE COMPOSITE SECURITY ELEMENT

BACKGROUND

1. Field

The present disclosure is generally related to security marks on documents.

2. Description of Related Art

Security marks, barcodes, and glyphs that are considered invisible to the eye are well known, and are used for many applications, such as tracking workflow and job security, high-security tickets, high-value documents and anti-counterfeiting applications. Some of these security marks are made with materials (e.g., ink or toner) which have almost no absorption in the visible spectrum of light, but have significant absorption in non-visible parts of the electromagnetic spectrum (i.e., to the human eye), such as ultraviolet (UV) or infrared (IR) radiation. Other marks rely on fluorescence of the material under suitable light, such as UV radiation.

Some of these applications use approximately "colorless" rather than truly "invisible" inks or toners. Such colorless materials are commonly "clear" inks/toners, i.e., materials similar to other inks/toners used in the system, except that they are substantially free of any colorants such as pigments or dyes, which give the other inks/toners their characteristic color properties in the visible range. These clear inks/toners typically have refractive indices and surface characteristics that are different from the substrate. In many marking technologies, such as xerography, lithography, flexography, and UV inkjet and solid inkjet technologies, the inks/toners exist in one or more layers on top of the paper. Consequently, the clear inks/toners can be detected by human observers, even without any special equipment, due to the gloss difference between the applied ink/toner and the bare substrate. For example, in some cases, when one alters the viewing angle of a page, the gloss of the invisible mark can be seen. For some applications this may not matter, but where truly invisible security marks are required, these materials are inadequate.

This gloss differential is a problem for such materials. In some cases, it has been possible to match closely the gloss of an ink or toner with a gloss of a particular substrate (e.g., uncoated paper) that the ink/toner is applied on. However, even though it may be possible to match the gloss of a particular ink to one particular substrate, developing and using a different ink/toner for each substrate is inconvenient and not necessarily feasible. For example, the ink/toner selected most likely will not match the gloss on other papers or substrates (e.g., gloss coated paper). Generally, the ink or toner can have a gloss appearance very different from that of the default paper or other papers that may be used in the printer.

Additionally, the above matching approach would require different inks or toners to be made (and then installed in the printer) for each substrate. This is also not a practical and/or feasible solution.

Thus, although attempts have been made to match the gloss of inks and toners to that of the substrate, such an approach has limited success.

SUMMARY

One aspect of the disclosure provides a composite security element on a substrate. The composite security element includes a first pattern mark and a second pattern mark. The first pattern mark is applied using a first marking material and the second pattern mark is applied using a second marking material. The first pattern mark and the second pattern mark are indistinguishable from each other under radiation of wavelengths within the visible spectrum and distinguishable from each other under radiation of at least some wavelengths outside the visible spectrum.

Another aspect of the disclosure provides a composite security element on a substrate. The composite security element includes a first pattern mark in an active marking material that is reactive to radiation of at least some wavelengths outside a visible spectrum; and a second pattern mark in a passive marking material that is unreactive to radiation of wavelengths outside the visible spectrum. The first pattern mark is distinguishable from the second pattern mark by a naked human eye or by a machine when exposed to radiation of wavelengths outside the visible spectrum and indistinguishable from the second pattern mark by at least the naked human eye when exposed to radiation of wavelengths within the visible spectrum.

Yet another aspect of the disclosure provides a method for applying a composite security element to a substrate using a printing apparatus. The printing apparatus has at least one marking material applicator. The composite security element includes a first pattern mark and a second pattern mark. The method includes:

marking the first pattern mark in a first marking material on the substrate using the at least one marking material applicator; and marking the second pattern mark in a second marking material on the substrate using the at least one marking material applicator.

The marking of the second pattern mark renders the first pattern mark and the second pattern mark indistinguishable from one another in radiation of wavelengths within the visible spectrum.

Other features and advantages of the present disclosure will become apparent from the following detailed description, the accompanying drawings, and the appended claims.

DETAILED DESCRIPTION

This disclosure proposes the use of two marking materials (e.g., clear or substantially colorless ink or toners) for digitally watermarking (e.g., for security and/or authentication purposes) a security mark on a substrate with one material, and rendering the security mark substantially indistinguishable or unreadable in visible light (by the naked human eye) by the marking of the other material. Although reference may be made to marking materials as one or more inks throughout this disclosure, it should be understood that toners or other materials for marking may be used for the herein described composite security element, and the method for marking the same.

For purposes of simplicity only, the term "security mark" is used throughout this disclosure to describe a mark or an overcoat that is applied to a substrate (or document). A "security mark" is defined as an indicating mark that is used for identification or authentication purposes, and in some cases may include any one or number of shapes and/or patterns such as text, number(s), a logo, picture(s), barcode(s), glyph(s), and/or the like. The security mark may comprise a predetermined or random pattern. Throughout this disclosure, the term "security mark" is used interchangeably with "first pattern mark" when referencing its application to a substrate. A substrate can comprise any number of objects or materials including, but not limited to, paper, document(s), currency, tickets, credit cards, licenses, coupons, packaging, and the like. The substrate can receive any size or shape security mark, and be provided in any number of locations (e.g., on a front or back surface). The security mark—or first pattern mark—is part of the herein disclosed "composite security element." As further described below, a composite security element comprises a plurality of marks (first and second pattern marks) applied to a substrate using two or more marking materials. The second pattern mark may comprise a predetermined or random pattern. As further described below, the second pattern mark renders the first pattern mark indistinguishable in visible light such that non-visible light (e.g., UV or IR light) must be used for viewing or sensing the security mark.

The composite security elements and/or security marks in the illustrated embodiments are shown in dashed lines in the provided Figures for illustrative purposes only, because, as further described in some embodiments below, the mark(s) is/are printed in clear or colorless ink, and thus may not be readily distinguishable from the substrate. In some embodiments, the marking materials and substrate have substantially similar gloss characteristics. In some embodiments, the element(s) or mark(s) are substantially invisible.

Figure 1:
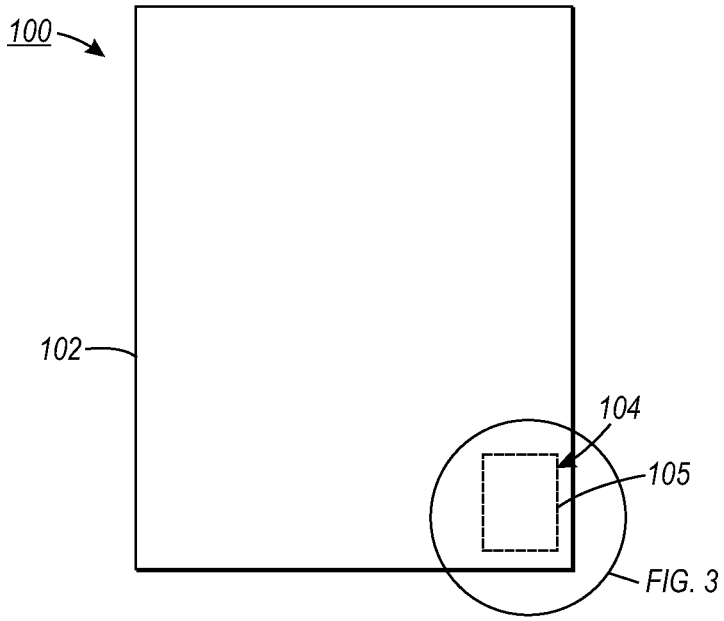
FIG. 1 illustrates an example of a page with a composite security element thereon in accordance with an embodiment of the present disclosure.
Figure 2:
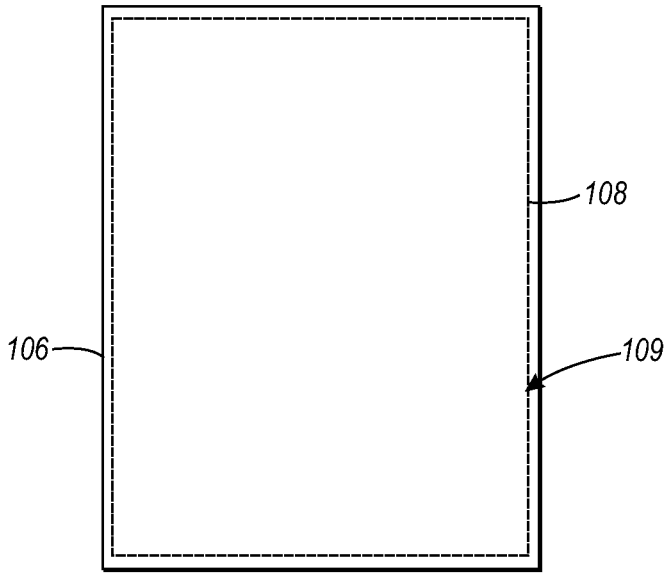
FIG. 2 illustrates an example of a page with a composite security element thereon in accordance with another embodiment.

FIG. 1 illustrates an example of a substrate 100 in the form of a page 102 with a composite security element 104 thereon (shown in dashed lines merely to indicate its location) in accordance with an embodiment of the present disclosure. The composite security element 104 may be used for overcoating, for example, ink based images and xerographic images on a substrate, document, or page. The composite security element 104 may be provided in or on a predetermined location or area 105 of the page 102. For example, the predetermined area may be in a corner, as shown in FIG. 1, on the side, on a back or reverse side, or in a center of the page. In this illustrated embodiment, the predetermined area for the mark is smaller than an area of the substrate 100, such as shown by area 105 of FIG. 1. However, in another embodiment, as illustrated in FIG. 2, the predetermined area for a composite security element 108 may comprise substantially an entire area of a page 106, shown as area 109 in FIG. 2.

No matter its size, the composite security element comprises a first pattern mark and a second pattern mark. In radiation of wavelengths within the visible spectrum (i.e., under visible light), the first pattern mark and the second pattern mark are indistinguishable from each other. The visible spectrum of light, also referred to as "visible light" throughout this disclosure, is defined by the electromagnetic spectrum and comprises electromagnetic radiation of wavelengths that are in a range from about 380 or 400 nanometers (nm) to about 760 or 780 nm. However, under radiation of wavelengths outside the visible spectrum, or "non-visible light", the first pattern mark and the second pattern mark are distinguishable from each other. For example, the composite security mark may be illuminated by ultraviolet light or infrared light (which are both regions of the electromagnetic spectrum which are outside the visible spectrum). Generally, ultraviolet (UV) light is electromagnetic radiation with wavelengths shorter than that of visible light, but longer than X-rays, in the range about 10 nm to about 400 nm. Infrared (IR) light is electromagnetic radiation with wavelengths between about 0.7 and about 300 micrometers. IR wavelengths are longer than that of visible light, but shorter than that of certain radiation microwaves.

In accordance with an embodiment, the first pattern mark (i.e., security mark) and second pattern mark are configured to be substantially invisible to at least the naked human eye when the composite security element is illuminated by light having wavelengths within the visible spectrum. The "naked human eye" refers to human visual perception that is unaided by a light-discerning or light-collecting optical device. In some embodiments, the first pattern mark and second pattern mark may be configured to be substantially invisible to a machine when the composite security element is illuminated by visible light. The "machine" refers to a device that is used to distinguish or discern a security mark. In an embodiment, a machine (e.g., a scanner) may include a light source. In another embodiment, a machine (e.g., a camera) may be aided by a light source (e.g., laser or radiation source).

The first pattern mark is applied using a first marking material, and the second pattern mark is applied using a second marking material. In this disclosure, the first pattern mark of the composite security element may be described as being marked or applied using an "active" marking material, i.e., a marking material that is configured to substantially react to radiation having at least some wavelengths outside a visible spectrum, such that the first pattern mark is distinguishable by the human eye or by a machine when exposed to such radiation. Also, in this disclosure, the second pattern mark of the composite security element may be described as being marked or applied using a "passive" marking material, i.e., a marking material that is substantially unreactive to the radiation having wavelengths outside a visible spectrum. That is, when non-visible light (i.e., light or radiation having wavelengths outside a visible spectrum) such as UV or IR light is used to illuminate the composite security element, for example, the pattern mark formed in the passive marking material will not react, and will not be readily distinguishable to the naked human eye (or, in some instances, to a machine). In some cases, the second pattern mark may be substantially invisible in both visible and non-visible light.

In an embodiment, the first (active) marking material is configured to have greater absorption in radiation of at least some wavelengths outside the visible spectrum than that of the substrate. Thus, the first pattern mark may additionally be distinguishable from the substrate under non-visible light.

Figure 3:
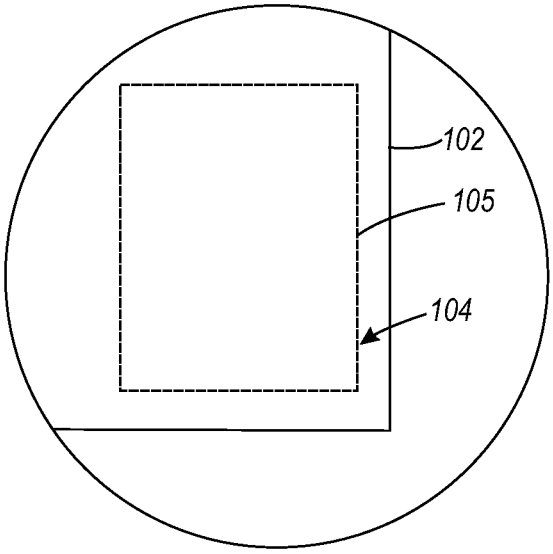
FIG. 3 illustrates a detailed view of a location of the composite security element of FIG. 1 in visible light.

Referring back to the illustrated embodiment of FIG. 1, the first and second patterns can be provided in the predetermined area 105. FIG. 3 illustrates a detailed view of a location or area 105 of the composite security element of FIG. 1, for example. In an embodiment, the first pattern mark is provided in a pattern in the predetermined area 105 of the substrate 102, i.e., its pattern is applied within bounds of area 105. In an embodiment, the second pattern mark is provided in a space at least around the first pattern mark. For example, in an embodiment, the space at least around the first pattern mark for the second pattern mark is within the predetermined area 105, i.e., the "negative space" (or any uncovered area) of the predetermined area 105 that is formed by the first pattern mark. As shown in the detailed view of FIG. 4, first (active) marking material may be applied in an exemplary shape (diamond-shape) to form first pattern mark 110 within the predetermined area 105. In an embodiment, second (passive) marking material is applied in the space around the first pattern mark and within the predetermined area 105, or the negative space formed by the first pattern mark 110. In this case, second marking material is marked or applied the form of triangular shapes within the predetermined area 105 to form second pattern marks 112. In an embodiment, the second pattern mark may be substantially flush with edges of the first pattern mark. In another embodiment, edges of the second pattern mark and edges of the first pattern mark may partially overlap.

In yet another embodiment, the second pattern mark is provided in a predetermined pattern that is sufficient to render the first pattern mark indistinguishable in visible light. For example, in an embodiment, the pattern of the second pattern mark may be based on the pattern of the first pattern mark.

In another embodiment, the second pattern mark can be a random or sporadic pattern which obscures the legibility of the first pattern mark. For example, the second pattern mark may comprise a random or non-random pattern that camouflages the first pattern mark, which may or may not cover and/or overlap or intertwine with the first pattern mark, the predetermined area, and/or a negative space. Accordingly, it should be understood that the second pattern mark need not to be contained to a predetermined area and/or a predetermined pattern for its application.

Figure 4:
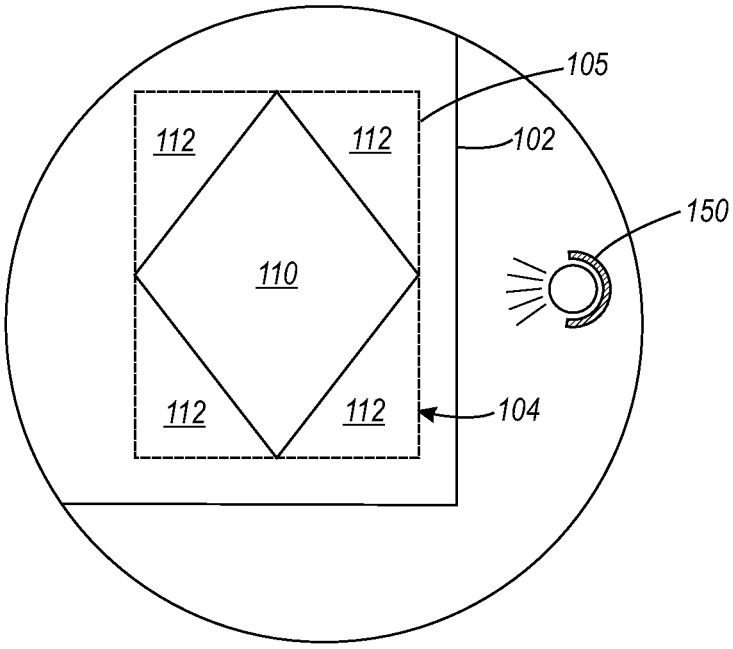
FIG. 4 illustrates a detailed view of a security mark (a first pattern mark) of the composite security element of FIG. 1 in radiation of wavelengths outside the visible spectrum, in accordance with an embodiment of the present disclosure.

In any case, the second pattern mark hides or scrambles the appearance of first pattern mark so that it is indistinguishable in visible light. That is, when composite security element 104 and predetermined area 105 are viewed in visible light by the naked human eye, at least the first and second security marks 110 and 112 are indistinguishable from each other. In an embodiment, substantially the entire composite security element 104 is indistinguishable, not recognizable, and/or undetectable, as shown in FIG. 3 (the dashed lines being provided for illustrative purposes only to show a predetermined area 105 where the composite security element 104 is located). However, under radiation of at least some wavelengths outside the visible spectrum, as shown in FIG. 4, the first pattern mark 110 is distinguishable from the second pattern mark(s) 112 to a naked human eye and/or a machine. Specifically, in FIG. 4 a light or radiation source 150 that emits radiation having at least some wavelengths outside the visible spectrum is shown illuminating at least the composite security element 104 of the substrate 102. The first pattern mark 110 reacts to such radiation from the radiation source 150 and is viewable to the human eye and/or machine. Radiation source 150 may comprise any number of devices including, but not limited to, a UV or IR light source. The radiation source 150 may be a part of, or used in conjunction with, a machine for distinguishing, viewing, or reading the security mark (first pattern mark 110). For example, a machine may comprise an infrared sensor or a camera.

Figure 8:
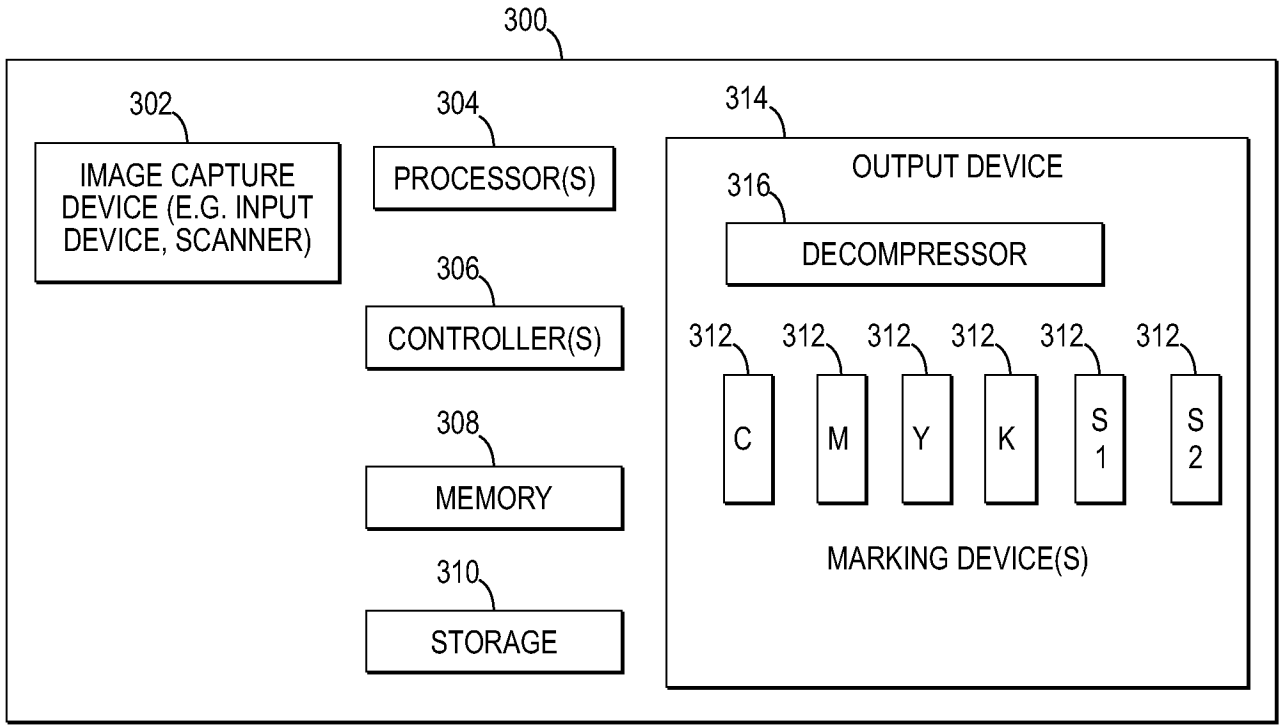
FIG. 8 is a block diagram illustrating an exemplary printing apparatus used to apply the composite security elements of FIGS. 1 and 2, in accordance with an embodiment.
Figure 9:
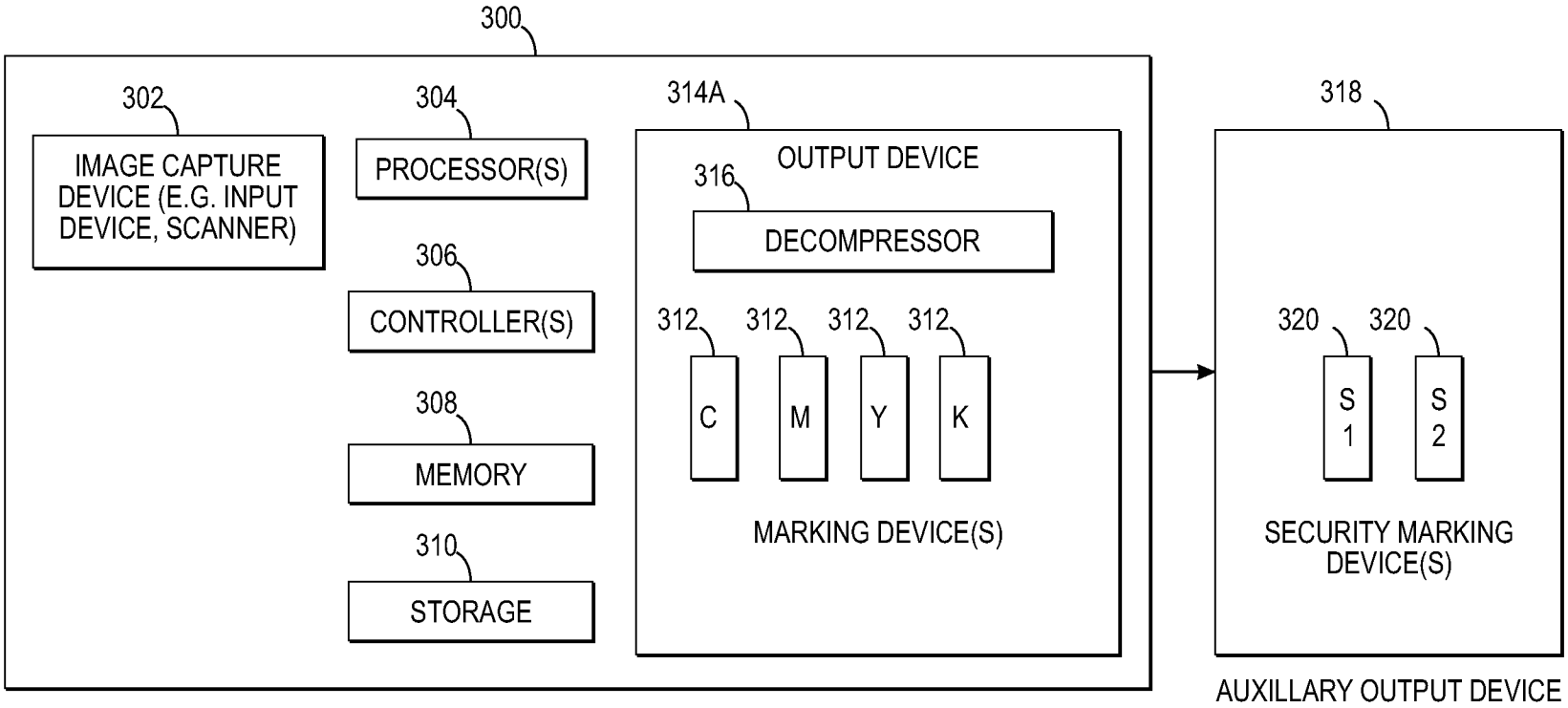
FIGS. 9 and 10 show block diagrams illustrating two alternate printing apparatuses used to apply a composite security element, in accordance with embodiments of this disclosure.
Figure 10:
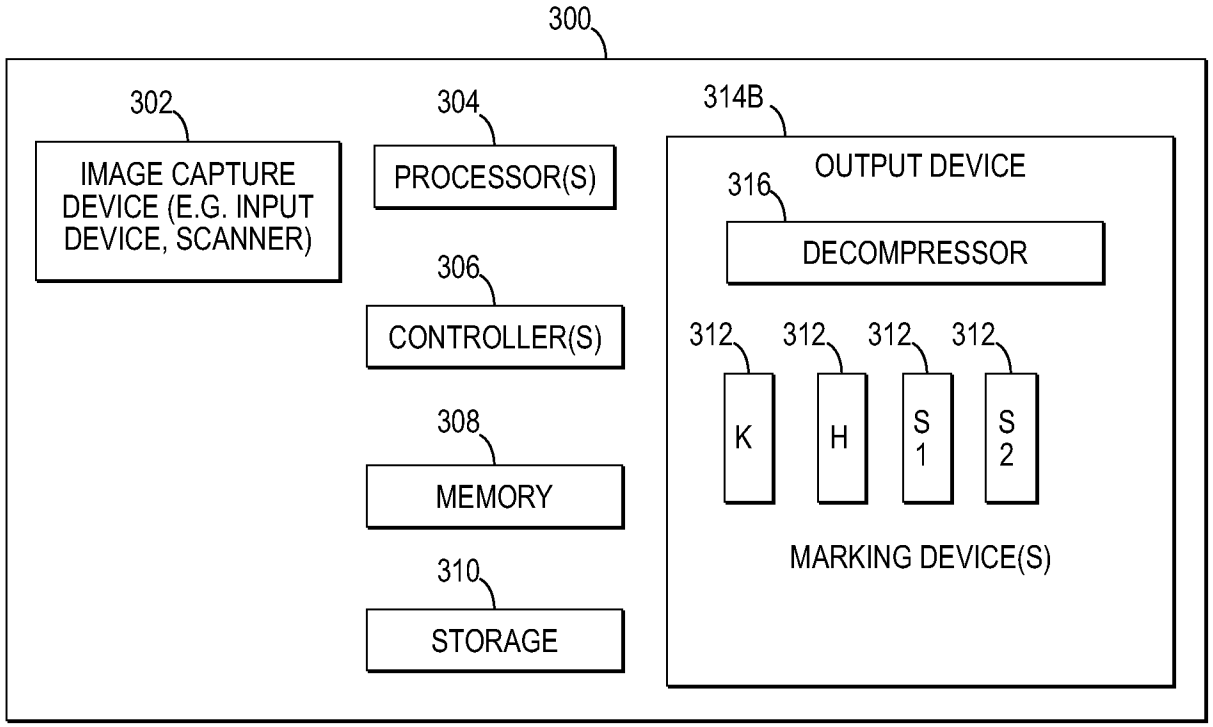

Radiation source 150 may be a part of a printing apparatus, such as one of the apparatuses 300 in FIGS. 8-10, or another output device, or may be a separate device. In an embodiment, a system such as the system described in U.S. Pat. No. 7,495,214 B2, assigned to the same assignee, Xerox Corporation, and which is incorporated herein by reference in its entirety, may be used for viewing the first pattern mark 110 (i.e., the security mark) of composite security element 104 and for authentication of substrate 102.

In addition to the above-noted features, in an embodiment, the first pattern mark and the second pattern mark are colorless. Both of the marking materials used for application of the composite security element on the substrate (i.e., the active and passive materials) may be at least colorless to light having wavelengths within the visible spectrum. As used throughout this disclosure, a "colorless" marking material is defined as a material that is substantially free of any colorants such as pigments or dyes, which give the other inks/toners their characteristic color properties in the visible range. For example, if the composite security element is used as an overcoat and applied over image data on the substrate (e.g., overcoats on ink based images and xerographic images), the colorless marking materials allows for printed image data to still be viewed through the composite security element. In an embodiment, the marking materials will be substantially colorless and the patterns will not be readily distinguishable or recognizable by at least a naked human eye (and in some instances, by a machine) in visible light.

Also, in an embodiment, the first pattern mark and the second pattern mark both are associated with a substantially similar gloss in at least light having wavelengths within the visible spectrum. Gloss is an optical property which is generally based on the interaction of visible light with physical characteristics of a surface (in this case, a surface of the marks). Some factors that affect gloss are: a refractive index of a material, and the roughness of the surface of the material. The roughness of the surface of the material may depend on processes for applying or treating the material (e.g., heat and/or fusing steps), and a roughness of a surface to which the material is applied. After application of the marking materials on the substrate, the first and second pattern marks will not be readily distinguishable to the at least the naked human eye because the gloss of each of the two marks is indistinguishable from each other when reflecting visible light (relative to the illumination angle). For example, as previously noted, one can alter the viewing angle of a substrate. "Viewing angle" refers to an angle measured with respect to a surface or plane of the substrate. In some cases, when one alters the viewing angle of a page or a substrate, the gloss of an invisible mark (i.e., gloss of the applied marking material) can be seen. With the application of two marking materials associated with a similar gloss to form first and second pattern marks on a substrate as described herein, the patterns are substantially or entirely indistinguishable from one another. For example, in an embodiment, when the first (active) marking material is applied in a positive space to form a first pattern mark, such as 110 in an area 105 as shown in FIG. 4, and a passive marking material is applied in the remaining negative space to form a second pattern mark, such as 112 in area 105, at least the diamond-like shape of first pattern mark 110 would not be distinguishable from the triangular-like shapes of second pattern mark 112. That is, in accordance with an embodiment, after application of first and second marking materials on an area of the substrate (e.g., in the predetermined area 105), with or without any subsequent processing such as a fusing operation, the area has a substantially uniform gloss when reflecting light having wavelengths within the visible spectrum.

In an embodiment, the first and second pattern marks are both colorless and have similar gloss values. In an embodiment, the gloss of the pattern marks is substantially similar or the same as that of the substrate.

In some embodiments, the marking materials can have a gloss appearance that is different from that of a default paper or substrate used in a printing apparatus. Thus, there may be a possibility that the gloss of the first and second pattern marks may be visible at some viewing angle(s) because of gloss differential (i.e., because the gloss of the pattern marks is slightly or more different than the gloss of the substrate they are marked on). For example, the area for application (e.g., predetermined area 105) may be visibly detectable by the eye (with respect to the substrate's surface) when viewed at a certain angle. However, even if the area of the composite security element is visible based on a gloss differential as compared to the surface of the substrate it is marked on, the first pattern mark and/or second pattern mark would still be indistinguishable to the naked human eye, because the gloss of the marking materials would be substantially the same when viewed in light of the visible spectrum. Therefore, the pattern marks will not be readily distinguishable and/or viewable by at least the human eye, unless non-visible light is directed at the composite security mark.

The first and second marking materials may comprise a matte or a glossy finish on a substrate. In an embodiment, the finish of the marking materials for first and second pattern marks is based on a finish of the substrate they are marked on. The first and second marking materials can have any gloss value (e.g., as measured by a gloss meter) and are not meant to be limiting. For example, the TAPPI (Technical Association of the Paper and Pulp Industry) has a standard identified as T-480 which defines a 75 degree glossmeter geometry. In accordance with a non-limiting embodiment, the first and/or second marking materials have a gloss value which may be substantially identical when specified in TAPPI T-480 gloss units. In another embodiment, first and second marking materials may or may not have gloss values that are similar to that of the substrate.

In accordance with another embodiment of this disclosure, the gloss of the first and second pattern marks is substantially similar to a gloss of a surface of the substrate when viewed in light having wavelengths within the visible spectrum. When the surface of the substrate and the composite security element are both associated with a substantially similar gloss, substantially little or none of the composite security element or its patterns applied thereon are distinguishable in the visible spectrum by the naked human eye at substantially any angle. Even if the substrate were to be angled or tilted to one or more viewing angles, the substrate would have substantially the same gloss across its entire surface because the substrate and marking materials have substantially the same gloss characteristics.

The substrate on which the marking materials/pattern marks are applied may comprise a matte or a glossy surface and is not meant to be limiting.

The application and/or area (e.g., area 105) of a substrate in which the first and second marking materials are applied are not meant to be limiting. Also, the size, shape, and/or patterns of first and second pattern marks are not meant to be limited to the illustrated embodiments. For example, as noted previously, the pattern marks may be in the form of text (words), numbers, symbols, barcodes, glyphs, and the like.

Figure 5:
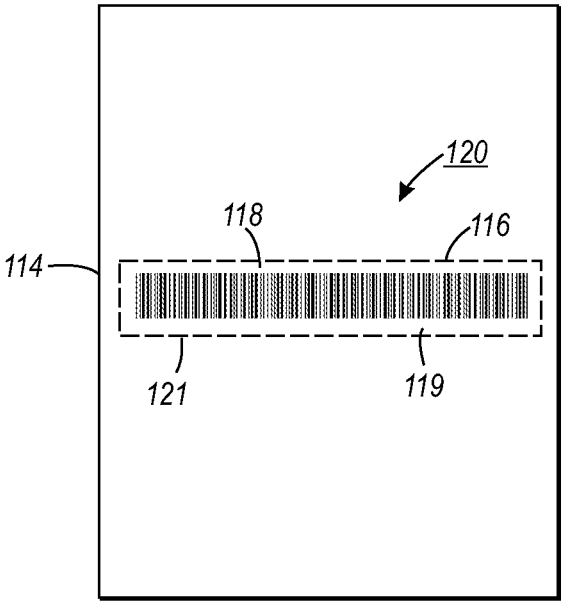
FIGS. 5 and 6 each illustrate pages with a composite security element thereon in accordance with alternate embodiments of the present disclosure.

FIG. 5 illustrates an example of a page with a composite security element 120 thereon in accordance with another embodiment. The first pattern mark 118 is marked using a first (active) marking material and provided in a predetermined area 116 of a substrate 114. In this illustration, the first pattern mark is in the form of a bar code. The second pattern mark 121 is marked using a second (passive) marking material. In an embodiment, the second pattern mark 121 may be provided to at least partially render the first mark 118 indistinguishable in visible light. For example, the second pattern mark 121 may be provided over at least the predetermined area 116. In an embodiment, the second (passive) marking material for the second pattern mark 121 includes the first pattern mark 118. Specifically, the passive marking material is applied over the first pattern mark 118 to substantially cover the area of the first pattern mark 118 and substantially the entire area of the predetermined area 116. In another embodiment, the second pattern mark 121 may be applied beyond the predetermined area 116.

In an embodiment, the size of the second pattern mark may be slightly or significantly larger than the size of the first pattern mark. In another embodiment, the second pattern mark may be substantially similar in size to the first pattern mark (e.g., to just cover the first pattern mark).

In another embodiment, when the first pattern mark 118 comprises an area that is smaller than the predetermined area 116, as shown in FIG. 5, the application of the passive marking material for the second pattern mark 121 is provided in a space at least around the first pattern mark 118. In an embodiment, the space at least around the first pattern mark (for the second pattern mark) is within the predetermined area 116, i.e., in the negative space 119 (the space not covered by active marking material) left in the predetermined area 116, formed from the first pattern mark 118. However, it is to be understood that the first pattern mark and active marking material may also substantially cover the predetermined area 116. In such an embodiment where the first pattern mark 118 is in the predetermined area 116, the second marking material may be marked to cover at least the predetermined area 116. Alternatively, the second marking material may be marked in an area that is smaller or larger than the predetermined area, while still rendering the first mark 118 indistinguishable in visible light. In an embodiment, the second pattern mark 121 extends beyond the predetermined area 116. For example, the second pattern mark 121 may extend slightly beyond the first pattern mark 118 onto the substrate, or cover more or substantially all of the substrate, such as shown and described with respect to the embodiment of FIG. 6.

In yet another embodiment, the first pattern mark 118 may be marked or applied to cover part and/or substantially the entire predetermined area 116 of the substrate 114, and the second pattern mark 121 may be marked or applied to a part or whole of the remaining uncovered (i.e., not marked by the first marking material) surface of the substrate 114. In an embodiment, the second pattern mark is provided over substantially an entire surface of the substrate, including marking over the first pattern mark.

Figure 6:
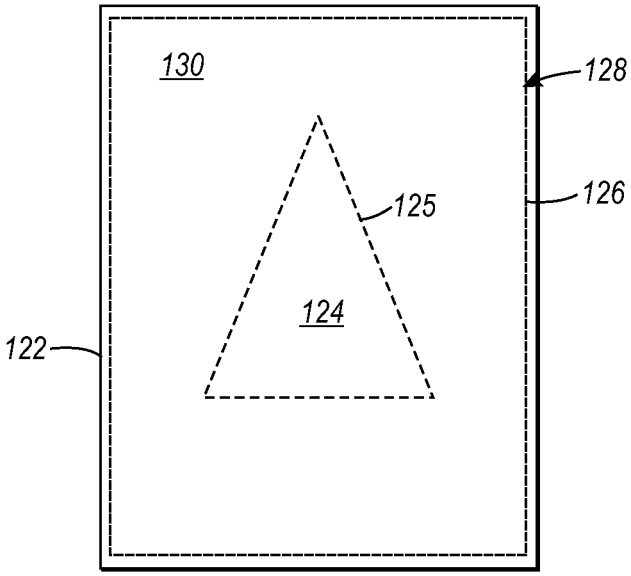

FIG. 6 illustrates an example of a page with a composite security element 128 thereon in accordance with an embodiment. In this illustrated embodiment, the first pattern mark 124 is provided in a predetermined area 126 of the substrate 122. The predetermined area 126 includes substantially an entire surface of the substrate 122. Specifically, in an embodiment, the first pattern mark 124 comprises an area 125 that is smaller than the predetermined area 126. The second pattern mark 130 may also be provided in a predetermined area 126 of the substrate 122. In an embodiment, the second pattern mark 130 may be applied over the space at least around the first pattern mark 124 (the negative space) of the predetermined area 126 that is formed by the first pattern mark, i.e., over the space surrounding but not including the illustrated area 125 (in this case, the triangular area). In another embodiment, the second pattern mark 130 may be applied over the first pattern mark 124 to cover the first pattern mark 124 and the predetermined area 126.

In another embodiment, the second pattern mark 130 is provided over substantially an entire surface of the substrate 122, e.g., in the form of an overcoat, no matter the size of the predetermined area for marking the first pattern mark (the security mark). For example, the predetermined area 126 may be sized for marking the first pattern mark.

In yet another embodiment in accordance with this disclosure, a composite security element may be applied to a surface of a page, substrate, or document using previous and/or known methods and marking materials. Then the surface of the substrate is covered—i.e., both the composite security element and any other remaining areas—with a second pattern mark by application of second (passive) marking materials as described herein. In a similar manner as described above, there is no differential-gloss issue on such a substrate. The security mark (or watermark, or first pattern mark) remains substantially indistinguishable (i.e., invisible) under normal visible light, but at least the first pattern mark can be distinguishable from the second pattern mark when UV or IR light is applied.

In either FIGS. 5 and/or 6, the second pattern mark may be marked on the substrate to be substantially flush with edges of the first pattern mark. In another embodiment, edges of the second pattern mark and edges of the first pattern mark may partially overlap.

The method and composite security element embodiments as disclosed herein substantially reduce and/or eliminate known problems in the art related to gloss differentials (e.g., related to a visible differential between the mark and the substrate, and/or related to a visible differential in marking materials used for the security mark, when viewed at a viewing angle).

This disclosure also reduces and/or eliminates any need to match the gloss of the marking material(s) to the substrate or paper, as in previous works. This is because the mark which may be used for security or authentication, i.e., the first pattern mark, is indistinguishable from the second pattern mark (no matter its application) by the naked human eye. The first pattern mark is only distinguishable and/or visible to the human eye and/or machine under an application of radiation having at least some wavelengths outside the visible spectrum. Additionally, because the first pattern mark and second pattern mark are associated with substantially similar gloss values (no matter the size of the predetermined area), there is substantially no differential gloss between them in light having wavelengths within the visible spectrum. Therefore, the pattern marks are indistinguishable from each other in visible light by looking at their specular gloss. The first pattern mark and second pattern mark can not be readily distinguishable from one another at any viewing angle, without application of radiation having at least some wavelengths outside the visible spectrum, such as UV or IR radiation.

Figure 7:
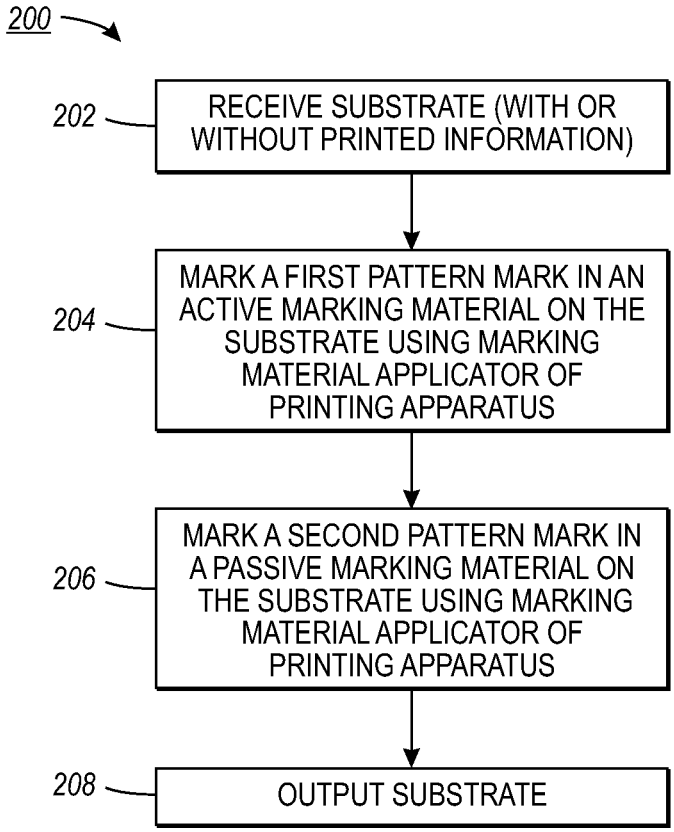
FIG. 7 illustrates an exemplary flow chart/block diagram of a method for applying a composite security element to a substrate using a printing apparatus, in accordance with an embodiment.

FIG. 7 illustrates an exemplary flow chart/block diagram of a method 200 for applying a composite security element to a substrate using a printing apparatus, in accordance with an embodiment. For example, any one of the printing apparatuses 300 as described with respect to FIGS. 8, 9, and 10 may be used to implement method 200. Generally, as further described below, the printing apparatus for implementing method 200 may comprise any device configured to apply at least two marking materials using one or more marking material applicators (e.g., print heads, jets, xerographic subsystems, etc.).

The method 200 as illustrated comprises receiving a substrate for applying or marking with at least first (active) and second (passive) marking materials, as shown in block 202. In an embodiment, the substrate may comprise printed information thereon when received. In an embodiment, printed information may be provided or marked with (consecutively or concurrently) the application of the active and passive marking materials. As previously noted, the type of substrate to which the active and passive marking materials is applied should not be limiting.

After the substrate is received at 202, a first pattern mark is marked at block 204 in an active marking material on the substrate using at least one marking material applicator of the printing apparatus. The active marking material may comprise a fluorescent, a luminescent, a phosphorescent, or a scintillating material, for example, or a material that has absorption characteristics in the non-visible wavelengths which are significantly higher than that of the second marking material and/or substrate. Then, a second pattern mark is marked at block 206 in a passive marking material on the substrate using the at least one marking material applicator of the printing apparatus. In an embodiment, both the active marking material and the passive marking material are colorless to radiation having wavelengths within the visible spectrum. Also, both the first pattern mark and the second pattern mark are associated with a substantially similar gloss when reflecting light having wavelengths in the visible spectrum of light. Then, the substrate may be output, as shown at block 208.

In an embodiment, the gloss of the first and second pattern marks is substantially similar to a gloss of the substrate they are applied thereto in light of the visible spectrum.

The method 200 is not meant to be limiting and may comprise additional or subsequent steps other than those shown in FIG. 7. For example, in an embodiment, the marking at block 204 comprises marking the first pattern mark in a predetermined area of the substrate. In an embodiment, the predetermined area of the substrate is smaller than an area of the substrate. However, it should be understood that the predetermined area for applying the composite security element is exemplary in the illustrated embodiments and is not meant to be limiting. For example, the size(s) and location(s) of a predetermined area for applying the composite security element on a substrate may be changed or altered.

In an embodiment, the marking of the second pattern mark at block 206 comprises rendering the first pattern mark and the second pattern mark as indistinguishable from one another in radiation of wavelengths within the visible spectrum. In an embodiment, this may include marking the second pattern mark in a space at least around the first pattern mark.

In an embodiment, the passive marking material and the active marking material are arranged side-by-side. For example, the first and second patterns may be applied to form a single layer of clear or colorless ink on the substrate. In another embodiment, the marking at block 206 comprises marking the second pattern mark in or over at least the predetermined area of the substrate. In yet another embodiment, the marking at block 206 comprises marking the second pattern mark over substantially an entire surface of the substrate. Such exemplary embodiments have been shown and described above with respect to FIGS. 3-6.

Moreover, it is noted that the order of application of the first and second marking materials is not meant to be limiting. Any reference to applying or providing a second marking material (or second mark) "over" or "on top of" (or other similar references) a first marking material (or first mark) is not meant to be limiting. Rather, it should be understood that the application of the first and second marking materials may be reversed, or concurrent, or even more than once. For example, it is within the scope of this disclosure that a second marking material may be applied to a substrate, followed by an application of a first marking material (the material for the security mark, and that is configured to react to non-visible light). Alternatively, it is understood that either or both of the first and second marking materials may be applied to a substrate more than once. Thus, the steps of method 200 as described herein are not limiting in their order.

Also, it should be understood that this disclosure also includes methods for applying more than one composite security element to a substrate, as well as a substrate comprising more than one composite security element. For example, in some embodiments, there may or may not be more than one predetermined area on a substrate for applying a first marking material and/or a second marking material. Furthermore, it should be understood any combination of the first and second pattern marks may be applied to, used with, and/or provided on a substrate. In an embodiment, it is envisioned that a composite security element (i.e., a combination of a first pattern mark in a first (active) marking material and a second pattern mark in a second (passive) marking material) may be applied or provided on a substrate in combination with one or more additional marks in a marking material on a substrate. For example, both a composite security element and an additional first pattern mark (or other security mark in a reactive or active marking material) may be provided on substrate. Any number of marking materials (active or passive) may be provided on the substrate in addition to the marking materials for the composite security element, as described herein.

Additionally, application of a first pattern mark in a first marking material to a substrate either alone or in combination with second marking material need not have a similar shape for each application. For example, in an embodiment where first marking material is used to apply more than one security mark to a substrate (with or without second marking material), each application may comprise a separate and distinct pattern or design. In an embodiment, an application of first marking material to first substrate may comprise a substantially distinct design as compared to a second substrate. Similarly, a second marking material may be applied in a substantially distinct design on a substrate.

Generally, any suitable printing apparatus may be employed to implement method 200 and to place the pattern marks on the substrate or paper. The marking materials of this disclosure can be used in or applied by an image processing apparatus configured to generate an ink-based or toner-based image on a substrate, followed by, or preceded by, or by consecutively applying the first (active) and second (passive) marking materials onto the substrate. For example, the printing apparatus may be a machine that incorporates a plurality of marking material applicators, stations, or housings, such that color marking materials (e.g., cyan, magenta, yellow, and black, or CMYK), the active marking material, and the passive marking material may be housed therein for application to the substrate. If a device comprises six toner developer stations, for example, two of the stations may be used for the disclosed marking materials (each being provided in a separate station) (e.g., see FIG. 8).

In another embodiment, for example, the first and second marking materials may be used in place of one or more color marking material applicators in a printing apparatus. For example, a four-color ink machine may be configured such that two of the color cartridges are replaced (e.g., temporarily) by two cartridges carrying first and second marking materials (e.g., see FIG. 10). Any remaining colors may still be used for printing. For example, the first and second marking materials can be used with monochrome printers. In an embodiment, the first and second marking materials can be used in two color printing, e.g., a user may decide to replace a yellow (Y) and cyan (C) cartridges so that black (K) and magenta (M) may still be used along with active and passive materials for output on the substrate.

Of course, such exemplary printing devices are not meant to be limiting. For example, in yet another embodiment, the first and second marking materials are applied using a separate printing apparatus or device, which may be an auxiliary device that is part of the printing apparatus, or an external device (e.g., see FIG. 9) associated therewith.

The herein described embodiments may be used in inkjet device, such as, for example, a solid inkjet printer, an aqueous inkjet printer, or a UV inkjet printer, or they may be used in an electrophotographic printing system or a lithographic printing system.

For explanatory purposes only, FIG. 8 is a block diagram illustrating an exemplary printing apparatus 300 that may be used in accordance with an embodiment to apply a composite security element to a substrate. FIGS. 9 and 10 illustrate two alternate printing apparatuses that may be used in accordance with embodiments to apply a composite security element. The illustrated elements of apparatus 300 of any of FIGS. 8-10 may be a part of a computer system, device, or apparatus such as a xerographic system, a photocopier, a printing device, or a multi-function device (MFD). In an embodiment, the apparatus 300 may be a phase change or solid or UV-cured ink jet printing system, or electrophotographic printing system.

For example, the apparatus 300 may comprise an image capture device 302, at least one processor 304, a controller(s) 306, memory 308 and/or storage 310, marking devices 312, and an output device 314. Each of the devices shown in system 300 may also be considered modules, and, therefore, the terms "device" and "module" are used interchangeably herein. Furthermore, the devices or modules illustrated in FIGS. 8-10 (further described below) are not meant to be limiting. It is to be understood that any number of elements or modules may be used (e.g., more or less modules may be used and/or combined) and that additional operations or processes besides those described below may be provided.

Generally, some of devices or modules shown in FIG. 8-10 are known by those of skill in the art and are therefore not discussed in great detail herein. For example, the image capture device 302 is configured to provide and/or receive image data, such as an input device. The image capture device 302 may comprise any type of device for providing, receiving and/or inputting image data, such as an input image terminal, scanning device, facsimile device, computing device, copying device, MFD, storage device, etc. At least one processor 304 may be configured to process pixels of the image data in order to process image data for output, for example. Controller 306 may be used to direct or control any number of modules or devices in system 300. The at least one processor 304 may be instructed by one or more controllers 306 to process the image data that is provided or received. The processor or processing elements may be a combination of image processing elements or modules which comprise software and hardware elements that may perform a number of operations on the image data received from the image capture device 302 using a set of parameters. The parameters may be used to convert the images to the format desired as output (e.g., high quality) along an image path. In embodiments of the present disclosure, the processor(s), for example, may be made in hardware, firmware, software, or various combinations thereof. The present disclosure may also be implemented as instructions stored on a machine-readable medium, which may be read and executed using one or more processors. For example, memory 308 or storage 310 may be used to store image data, instructions, or other information related to processing the image data and/or the processed image data of the apparatus. In an embodiment, the processor 304 (and/or other devices such as controller 306) may execute machine readable executable instructions stored in memory 308 or storage 310. For example, the method 700 described herein may be stored in storage 310 in the form of computer executable instructions so as to provide a computer readable media or data structure that may be executed by a computer to direct a computer to perform the disclosed method to apply a composite security element to a substrate. In one embodiment, the machine-readable medium may include various mechanisms for storing and/or transmitting information in a form that may be read by a machine (e.g., a computing device). For example, a machine-readable storage medium may include read only memory, random access memory, magnetic disk storage media, optical storage media, flash memory devices, and other media for storing information, and a machine-readable transmission media may include forms of propagated signals, including carrier waves, infrared signals, digital signals, and other media for transmitting information. While firmware, software, routines, or instructions may be described in the above disclosure in terms of specific exemplary aspects and embodiments performing certain actions, it will be apparent that such descriptions are merely for the sake of convenience and that such actions in fact result from computing devices, processing devices, processors, controllers, or other devices or machines executing the firmware, software, routines, or instructions.

An output device 314 may be provided to output the image data (e.g., as noted in the method 700 at block 208). Output device 314 may be any type of device that is designed to output the image data. For example, the output device may be an MFD, printer, or copier, for example. In an embodiment, the output device 314 may decompress the image data and information in the background metadata before output. In some embodiments, a decompressor 316 is provided in output device 314 of system 300 to decompress image data before outputting the image data with output device 314, if needed. The decompressor 316 and output device 314 may be the same module, or separate modules.

The marking devices 312 are applicators, stations, printheads, or housings incorporated into the output device 314 of the apparatus 300 used to mark or apply marking materials, such as color and security inks for printing image data of a document and a composite security element thereon. In an embodiment, controller 306 is used to control one or more marking devices or applicators 312 of system 300. The marking applicators for the first (active) and second (passive) marking materials may comprise the same marking applicator or different marking applicators. Any number of marking applicators 312 may be used. For example, as previously noted, the printing apparatus 300 may be a machine that houses both color marking materials (e.g., CMYK), the first (active) marking material, and the second (passive) marking for application using applicators 312. FIG. 8 illustrates an example of such an embodiment. As shown, the output device 314 comprises six (6) marking material applicators 312—four (4) marking applicators 312 for application of color marking materials (one each for C, M, Y, K) and two (2) marking applicators 312 are for the two materials—first and second marking materials, S1 and S2—used for marking the composite security element.

In another embodiment, which is illustrated in FIG. 9, the first and second marking materials are applied using a separate printing apparatus or device 318. For example, apparatus 300 is a four (4) color ink printer, comprising output device 314A which has four marking devices 312—one each for C, M, Y, and K—for example. Additional marking stations are provided in a printing device 318. Printing device 318 is an external, auxiliary device that is associated with the printing apparatus 300. Printing device 318 comprises two marking devices or applicators 320, one for application of first (active) marking material (S1) and one for application of second (passive) marking material (S2). Applicators 320 of printing device 318 may apply the marking materials S1 and S2 before, during, or after marking with the marking applicators 312 of the output device 314. Although not shown, printing device 318 may include its own processor(s) and/or controller (s), or other modules. In an embodiment, printing device 318 and apparatus 300 are configured to communicate with each other.

FIG. 10 illustrates yet another embodiment showing an apparatus 300 that is a four (4) color ink printer comprising four marking devices 312 in its output device 314B. Two of the marking devices 312 are configured to mark a composite security element on a substrate using a first (active) marking material (S1) and second (passive) marking material (S2). The other two marking devices 312 may be used to mark image data of a document on the substrate using one or more inks. In an embodiment, a black ink (K) and a highlight color ink (H) may be used in the remaining two marking devices 312. The highlight color ink may be any selected color (e.g., cyan, or red) of marking material, for example.

In an embodiment, the four-color ink apparatus 300 of FIG. 10 may be configured such that at least two of the color cartridges are replaced (e.g., temporarily) by two cartridges carrying first and second marking materials. For example, the marking devices 312 of output device 314B may be typically used to mark process colors such as C, M, Y, and K inks (such as shown apparatus 300 in FIG. 9) as a standard or an existing option. However, as shown in FIG. 10, two of the four existing marking devices 312 are changed such that the two security inks S1 and S2 for applying the composite security element are used for security marking instead of using colored inks.

The processor 304, marking device(s) 312, and/or other associated modules of any of the apparatuses 300 illustrated in FIGS. 8, 9, and 10 may be used to perform or implement the non-limiting steps 202-208 as described in method 200 of FIG. 7, for example.

In some embodiments, although not shown, any of the apparatuses 300 and/or printing device 318 may comprise a curing device(s) for curing the marking material(s). For example, the curing device may be a device included in or associated with any one of the output devices 314, 314A, and/or 314B, or printing device 318.

In an embodiment, the apparatuses, system and method described herein may also include use of a light emitting source, such as radiation source 150 shown in FIG. 4, which emits radiation having wavelengths outside the visible spectrum, i.e., radiation having wavelengths at which the first (active) marking material reacts to (e.g., absorbs) the radiation, to thereby make the first pattern mark become distinguishable (or visible) from the second pattern mark, and/or the substrate. In an embodiment, the radiation emitting source produces light that has wavelengths in at least a part of the range of from about 10 nm to about 400 nm (UV light). In another embodiment, the radiation emitting source produces light with wavelengths in at least a part of the range between about 0.7 and about 300 micrometers (IR light). When the radiation emitting source is used, the first pattern mark may be visible to the human eye and/or machine, and then the document may be authenticated, for example.

In an embodiment, the apparatuses, system, and method also includes a machine or device that is used to distinguish or discern a security mark (the first pattern mark) when it is illuminated by non-visible light. In an embodiment, a machine (e.g., a scanner) may include a light source. In another embodiment, a machine (e.g., a camera) may be aided by a light source (e.g., laser or radiation source).

It should be understood that the security markings (i.e., first pattern marks) 110, 118, and 124 shown in FIGS. 4, 5, and 6 are for illustrative purposes only and that the shape, design, and layout should not be limited to the illustrated embodiments. For example, in an embodiment, a bar code (1-dimensional or 2-dimensional), text, or picture could be used as the first or second mark (rather than the illustrative diamond shape). In an embodiment, a bar code may be a security mark applied to a document or substrate, wherein the bars (normally dark areas) are marked using the first (active) marking material, and the stripes or spaces (normally light areas) are marked using the second (passive) marking material.

The marking materials for the first pattern mark and the second pattern mark as disclosed herein may comprise any number of materials including, but not limited to, inks or toners. For example, in an embodiment, the active marking material comprises a material from the group consisting of: fluorescent, luminescent, phosphorescent, or scintillating material, or a material that has absorption characteristics in the non-visible wavelengths which are significantly higher than that of the second marking material and/or substrate. In an embodiment, the marking material may comprise polymers or resins, and UV fluorescent component, for example. In an embodiment, materials and/or processes such as those described in U.S. Pat. No. 6,673,500, assigned to the same assignee, Xerox Corporation, and which is hereby incorporated by reference in its entirety, may be used as one or more of the herein disclosed marking materials for marking a composite security element.

Additionally, the qualities or features of the marking materials should not be limited. For example, it is within the scope of this disclosure that the first pattern mark and the second pattern mark are transparent. The first and second pattern marks may be transparent but not colorless, or both colorless and transparent, or in some applications, neither colorless nor transparent. In an embodiment, the color and transparency of the two pattern marks are substantially similar. For example, it may be desirable to utilize first and second marking materials with a tint or color that is transparent. Accordingly, it should be understood that a number of types and different marking materials may be used, so as the first and second pattern marks are indistinguishable from each other via at least a naked human eye in visible light. In an embodiment, for example, an existing marking material (for outputting an image on the substrate)—such as C, M, Y or K inks or toners—may be used as the passive marking material, in combination with another material, which is an active marking material. However, this example is not meant to be limiting.

While the principles of the disclosure have been made clear in the illustrative embodiments set forth above, it will be apparent to those skilled in the art that various modifications may be made to the structure, arrangement, proportion, elements, materials, and components used in the practice of the disclosure.

It will be appreciated that various of the above-disclosed and other features and functions, or alternatives thereof, may be desirably combined into many other different systems/devices or applications. Various presently unforeseen or unanticipated alternatives, modifications, variations, or improvements therein may be subsequently made by those skilled in the art which are also intended to be encompassed by the following claims.

What is claimed is:

1. A method for applying a composite security element to a substrate using a printing apparatus, the printing apparatus comprising at least a first marking material applicator and a second marking material applicator; the composite security element comprising a first pattern mark and a second pattern mark; the method comprising:

marking the first pattern mark in a first marking material on the substrate using the first marking material applicator in a predetermined area of the substrate; and, thereafter, marking the second pattern mark in a second marking material on the substrate in a space around the first pattern mark and within the predetermined area using the second marking material applicator, wherein the second marking material is different from the first marking material, and wherein the marking of the second pattern mark renders the first pattern mark and the second pattern mark indistinguishable from one another by a naked human eye within a visible spectrum of light and wherein the first pattern mark and the second pattern mark are substantially invisible to the naked human eye in radiation of wavelengths within the visible spectrum, wherein the space for marking the second pattern mark is only an unmarked area of negative space that is: around the first pattern mark, within the predetermined area, and unmarked by the first marking material; and wherein the marking of the second pattern mark further comprises marking entirely in all of the unmarked area of the negative space around the first pattern mark and within the predetermined area of the substrate that is unmarked by the first marking material.

2. The method according to claim 1, wherein the first pattern mark is distinguishable from the second pattern mark to a naked human eye and/or a machine when exposed to the radiation of at least some wavelengths outside the visible spectrum.

3. The method according to claim 2, wherein the first marking material comprises a material from the group consisting of: fluorescent, luminescent, phosphorescent, or scintillating material.

4. The method according to claim 1, wherein the first marking material and the second marking material are colorless.

5. The method according to claim 1, wherein the first pattern mark and the second pattern mark are transparent on the substrate.

6. The method according to claim 1, wherein the first marking material is configured to have greater absorption in radiation of at least some wavelengths outside the visible spectrum than that of the substrate and the second marking material.

7. The method according to claim 1, wherein both the first marking material and the second marking material are each associated with a substantially similar gloss such that there is no visible differential gloss in the applied composite security element.

8. The method according to claim 1, wherein the first pattern mark comprises a first shape or pattern, wherein the second pattern mark comprises a second shape or pattern, and wherein the second shape or pattern is different from the first shape or pattern.

9. The method according to claim 1, wherein a combination of marking the first pattern mark and marking the second pattern mark on the substrate comprises covering an entire predetermined area with one of the first marking material or the second marking material used for applying the composite security element such that there is no unmarked space in the predetermined area.

10. A method for applying a composite security element to a substrate using a printing apparatus, the printing apparatus comprising at least a first marking material applicator and a second marking material applicator; the composite security element comprising a first pattern mark and a second pattern mark; the method comprising:

marking the first pattern mark in a first shape in a first marking material in a predetermined area on the substrate using the first marking material applicator; and, thereafter, marking the second pattern mark in a second shape in a second marking material in the predetermined area on the substrate using the second marking material applicator, wherein the first marking material is different from the second marking material, wherein both the first marking material and the second marking material are each associated with a similar gloss, and wherein the marking of the second pattern mark is in all of a space around the first pattern mark that is unmarked by the first marking material within the predetermined area of the substrate, wherein the marking of the second pattern mark renders the first pattern mark and the second pattern mark indistinguishable from one another under radiation of wavelengths within a visible spectrum of light to a naked human eye, and wherein the second shape of the second pattern mark camouflages the first shape of the first pattern mark such that the first shape of the first pattern mark is indistinguishable from the second shape of the second pattern mark by the naked human eye within the visible spectrum.

11. The method according to claim 10, wherein the first marking material is different from the second marking material in that it is reactive under radiation of at least some wavelengths outside the visible spectrum and the second marking material is non-reactive under radiation of wavelengths outside the visible spectrum such that the first and second pattern marks are distinguishable from each other under radiation of at least some wavelengths outside the visible spectrum.

12. The method according to claim 11, wherein the first marking material comprises a material from the group consisting of: fluorescent, luminescent, phosphorescent, or scintillating material.

13. The method according to claim 10, wherein the first marking material and the second marking material are colorless.

14. A method for applying a composite security element to a substrate using a printing apparatus, the printing apparatus comprising at least a first marking material applicator and a second marking material applicator; the composite security element comprising a first pattern mark and a second pattern mark; the method comprising:

marking the first pattern mark in a first pattern or first shape in a first marking material in a predetermined area on the substrate using the first marking material applicator; and, thereafter, marking the second pattern mark in a second pattern or second shape that is different from the first pattern or first shape in a second marking material in the predetermined area on the substrate using the second marking material applicator, wherein both the first marking material and the second marking material are each associated with a similar gloss, wherein the first marking material is different from the second marking material in that it is reactive under radiation of at least some wavelengths outside a visible spectrum of light and the second marking material is non-reactive under radiation of wavelengths outside the visible spectrum, and wherein marking the second pattern mark in a second marking material on the substrate comprises marking the second pattern mark in an unmarked area of space that is around the first pattern mark and within the predetermined area and unmarked by the first marking material;

wherein the marking of the second pattern mark further comprises marking entirely in the unmarked area of the space around the first pattern mark and entirely within the predetermined area of the substrate that is unmarked by the first marking material; and wherein the marking of the second pattern mark renders the first pattern mark and the second pattern mark indistinguishable from one another by a naked human eye in the visible spectrum in the predetermined area on the substrate and substantially invisible to the naked human eye under radiation of wavelengths within the visible spectrum.

15. The method according to claim 14, wherein the first marking material comprises a material from the group consisting of: fluorescent, luminescent, phosphorescent, or scintillating material.

16. The method according to claim 14, wherein the first marking material and the second marking material are substantially colorless and substantially transparent.

17. The method according to claim 14, wherein the first shape of the first pattern mark is indistinguishable from the second shape of the second pattern mark.

18. The method according to claim 10, wherein the first pattern mark and the second pattern mark are transparent on the substrate.

19. The method according to claim 10, wherein the first marking material is configured to have greater absorption in radiation of at least some wavelengths outside the visible spectrum than that of the substrate and the second marking material.

20. The method according to claim 14, wherein the first marking material is configured to have greater absorption in radiation of at least some wavelengths outside the visible spectrum than that of the substrate and the second marking material.

21. The method according to claim 10, wherein the first pattern mark is distinguishable from the second pattern mark to a naked human eye and/or a machine when exposed to the radiation of at least some wavelengths outside the visible spectrum.

22. The method according to claim 14, wherein the first pattern mark is distinguishable from the second pattern mark to a naked human eye and/or a machine when exposed to the radiation of at least some wavelengths outside the visible spectrum.

* * * * *